United States Patent [19]

Jamison

[11] Patent Number: 4,471,591

[45] Date of Patent: Sep. 18, 1984

[54] AIR IMPERVIOUS SPLIT WALL STRUCTURE

[76] Inventor: Walter E. Jamison, Rte. 4, Box 89A, Ottawa, Kans. 66067

[21] Appl. No.: 521,030

[22] Filed: Aug. 8, 1983

[51] Int. Cl.[3] ..... L04C 1/00

[52] U.S. Cl. ..... 52/309.9; 52/309.16; 52/404; 52/408; 52/743; 428/71

[58] Field of Search ..... 52/404, 406, 407, 408, 52/410, 481, 309.9, 309.16; 428/71

[56] References Cited

U.S. PATENT DOCUMENTS

| | | | |
|---|---|---|---|
| 1,096,773 | 5/1914 | Vernon | 52/407 |
| 2,174,988 | 10/1939 | Landvall | 52/407 |
| 2,582,144 | 1/1952 | Miles | 20/4 |
| 3,258,889 | 7/1966 | Butcher | 52/407 |
| 3,305,993 | 2/1967 | Nelsson | 52/404 |
| 3,315,424 | 4/1967 | Smith | 52/404 |
| 3,381,429 | 5/1968 | Rich | 52/250 |
| 3,611,653 | 10/1971 | Zinn | 52/241 |
| 3,972,167 | 8/1976 | Vogeli | 52/481 |
| 4,103,464 | 8/1976 | Clifft | 428/71 |
| 4,177,618 | 12/1979 | Felter | 52/404 |
| 4,285,184 | 8/1981 | Turner, Jr. | 52/404 |

OTHER PUBLICATIONS

Brochure: Upjohn CPR, Contractor Application Manual for Residential Construction, (Using Spray-Applied CPR/Upjohn Resinate Insulation System), pp. 1-11, Jul. 1982.

*Primary Examiner*—Henry E. Raduazo

*Attorney, Agent, or Firm*—D. A. N. Chase; Michael Yakimo, Jr.

[57] ABSTRACT

A wall assembly comprising exterior and interior severally insulated wall sections combined to present a jointly insulated wall. A continuous sheath of cured foam insulates the exterior wall section and isolates the bracing studs therein from those of the interior wall section. The latter section is insulated with conventional fiberglass batts and is laterally adjacent the first wall section resulting in a jointly insulated common wall assembly impervious to air infiltration and highly resistant to thermal flow therethrough.

5 Claims, 5 Drawing Figures

AIR IMPERVIOUS SPLIT WALL STRUCTURE

BACKGROUND OF THE INVENTION

This invention relates to wall construction and more particularly to a wall assembly utilizing a double wall construction and associated insulative materials to present a wall assembly highly resistant to air infiltration and thermal flow therethrough.

In conventional wall construction, 2×4 or 2×6 studs are placed on 16 inch centers with the exterior wall sheathing nailed directly to the exterior faces of the studs to present a plurality of side-by-side stud cavities therebetween. Prior to nailing the interior wall board to the interior faces of the studs, insulative material is placed within the stud cavities to resist passage of thermal flow therethrough. The effectiveness of this resistance is conventionally referred to as the "R" value of the insulation.

Insulation in the form of fiberglass batts or a spray applied foam can be inserted between the studs to fill these stud cavities. The foam-type insulation offers a greater R-value per inch of material than that offered by conventional fiberglass batt insulation. Moreover the cured foam hugs the studs to preclude the appearace of cracks or crevices therebetween. The cured-foam may break away from the studs and present undesirable cracks and/or crevices which allow for undesired thermal infiltration therethrough. These cracks/crevices offer a path of lesser resistance to thermal flow between the exterior and interior walls of the wall assembly which degrades the R-value of the overall wall construction. Also, as the interior and exterior walls are nailed directly to the opposed stud faces a path of thermal flow between the interior and exterior walls via the interposed studs is presented. This path offers a lesser resistance to thermal air flow than that offered by the insulated stud cavities.

In response thereto, I have invented a wall construction utilizing the first and second rows of laterally spaced-apart and longitudinally offset studs for supporting a first foam-type and second batt-type insulation materials. The exterior wall sheathing is nailed to the first row of studs with the interior wall nailed to the face of the spatially displaced second row of studs. Subsequent to the affixation of the exterior sheathing to the first row of studs a polyurethane foam is sprayed into the stud cavities formed by the exterior wall sheathing and first row of studs. The foam overlaps the studs to present an uninterrupted sheet of cured form extending among the stud cavities and interposed between the first and second rows of studs so as to isolate the same. Fiberglass batt insulation is then placed between the studs of the second row with a vapor barrier and conventional interior wall sheathing then applied to the faces of the second row of studs.

The use of first and second rows of studs interrupts the extension of the studs between the exterior and interior walls and any accompanying thermal flow therethrough. The continuous, serpentine polyurethane sheet presents an air impervious barrier with the overlapping portions between the stud cavities transversely blocking any thermal flow through cracks or crevices presented upon separation of the cured foam from the studs. Finally the use of the fiberglass batts cost-effectively enhances the R-value of the wall construction. Accordingly, a wall assembly generally impervious to air infiltration and having an R-value approximating 30 is presented.

It is therefore a general object of this invention to provide a wall assembly offering a high degree of resistance to air infiltration and thermal flow therethrough.

Another object of this invention is to provide a wall assembly, as aforesaid, utilizing longitudinally and laterally offset first and second rows of wall-supporting studs for insertion of selected insulating materials therebetween.

A further object of this invention is to provide a wall assembly, as aforesaid, utilizing first and second severally insulated wall sections cooperating to present a jointly insulated wall.

Still another object of this invention is to provide a wall assembly, as aforesaid, utilizing an uninterrupted, spray-applied, insulative foam in one of the wall sections.

Another object of this invention is to provide a wall assembly, as aforesaid, which diminishes the effect of separation of the insulative material from the supporting studs.

A more particular object of this invention is to provide a wall assembly, as aforesaid, which interrupts the thermal flow between the interior and exterior walls via the supporting studs.

Other objects and advantages of this invention will become apparent from the following description taken in connection with the accompanying drawings, wherein is set forth by way of illustration and example, and embodiment of this invention.

DESCRIPTION OF THE PREFERRED EMBODIMENT

Figure 2:
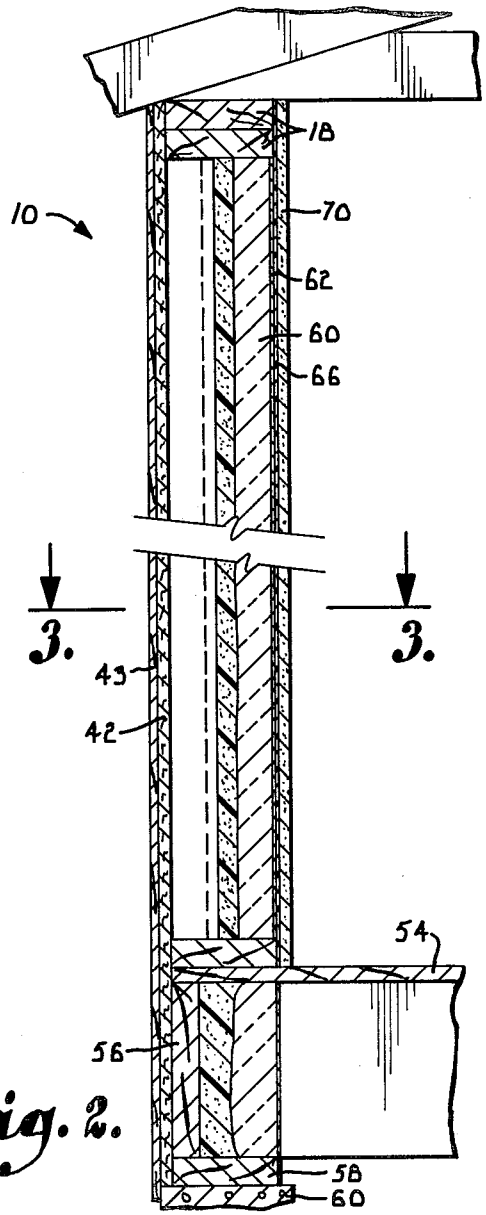
FIG. 2 is a sectional elevation end view of the wall assembly of FIG. 1 extending between the floor and ceiling of a house.
Figure 1:
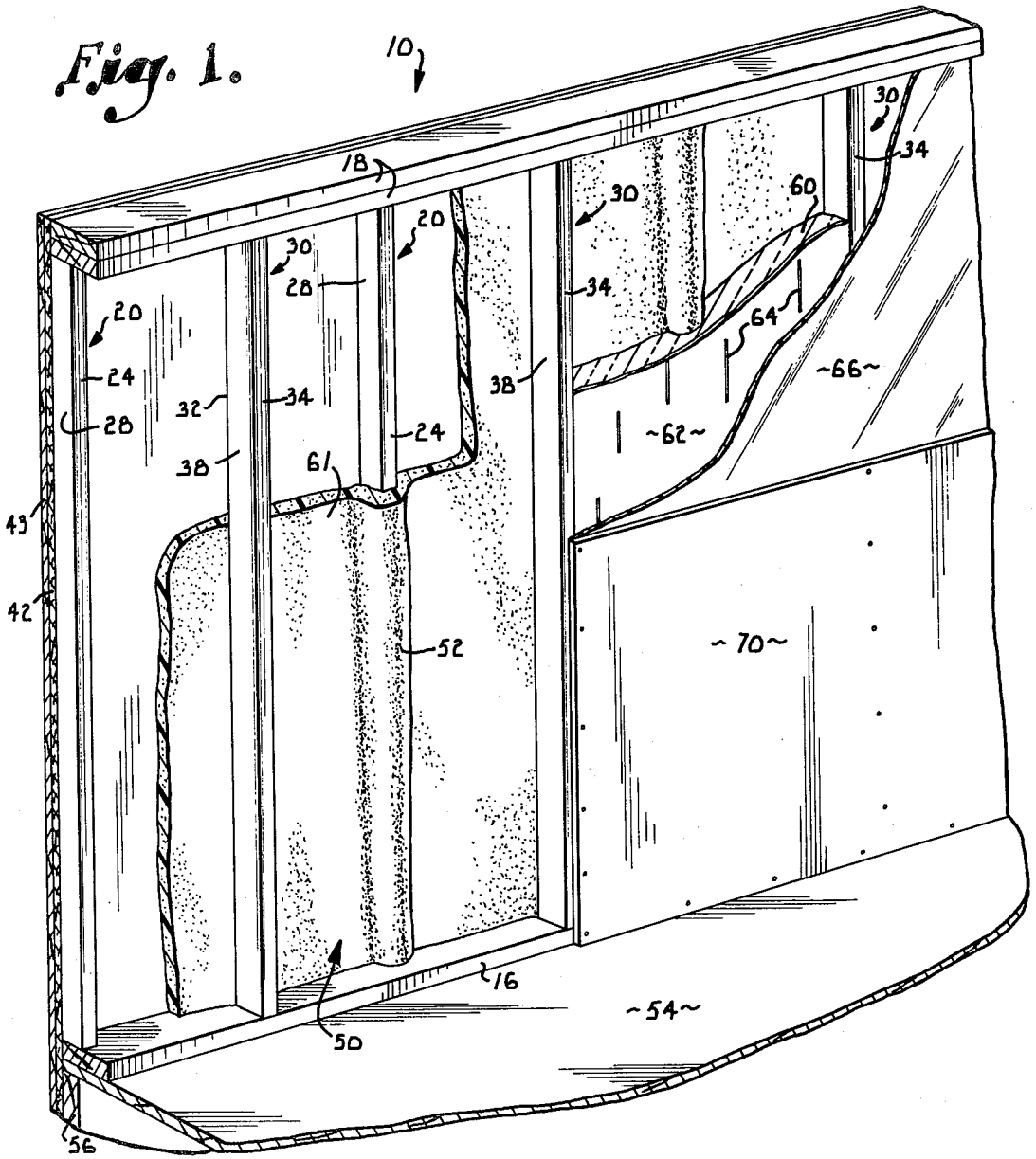
FIG. 1 is a perspective view of a portion of the wall assembly with portions of the first and second insulating materials, vapor barrier and interior wall broken away to show the cooperation of elements of the wall assembly.
Figure 3:
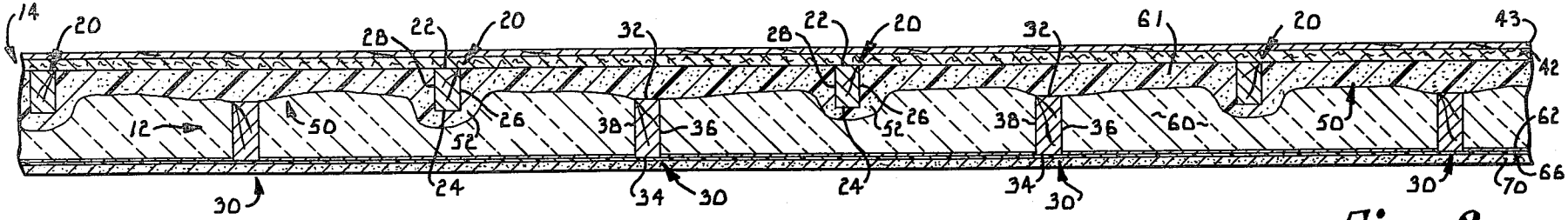
FIG. 3 is a sectional plan view, taken along line 3—3 in FIG. 2, and showing the cooperating elements of the wall assembly.

Referring more particularly to drawings, FIG. 1 illustrates a longitudinal portion of the wall assembly 10. The wall assembly 10 comprises first and second wall sections which respectively include inside and outside rows of studs 12, 14, as best illustrated in FIG. 3, extending between a 2×6 sole plate 16 and 2×6 header plates 18. 2×3 studs 20 of the outside row 14 of studs extend between the outside lateral portions of the sole 16 and header plates 18. Sole plate 16 is nailed atop a horizontal sheet of tongue and groove plywood 54 presenting the sub floor or the room. This sub floor 54 is positioned atop a rim joist 56 which is affixed to a sill plate 58 lying atop the foundation wall 60. Each stud 20 presents narrow nailing faces 22, 24 and web faces 26 and 28 and are spaced-apart on two foot centers along the longitudinal extent of the sole 16 and header 18 plates.

The inside row 12 of studs 30 are 2×4 in dimension and are longitudinally displaced on two foot centers along the length of the sole 16 and header 18 plates. This inside stud row 12 is also laterally displaced from stud row 14 and longitudinally offset (one foot) therefrom. This spatial offset centers the studs 30 between the studs 20 so as to present one foot longitudinal displacements between the outside 20 and inside studs 30. Each stud 30 presents nailing faces 32, 34 and web faces 36 and 38 with nailing face 32 extending into the space spanning adjacent studs 20 of stud row 14.

Affixed to the nailing faces 22 of studs 20 is exterior wall sheathing 42 in the form of sheets of polystyrene bead board, ⅝" thermax board (R-value=5) or the like. In my present embodiment rough sawn siding 43 (⅜") is then applied thereto with the finished exterior siding then placed thereon.

The affixed sheathing 42 forms open stud cavities 50 as vertically defined by the opposed web faces 26, 28 of each pair of adjacent outside studs 20. These cavities 50 are filled with two inches of a sprayed-applied polystyrene foam 61 having an R-value of at least R-13. An example of such an insulation is a polyurethane foam known as RESINATE TM insulation available from the UpJohn Company. The applicator sprays the foam along the opposed web faces 26, 28 of the stud cavity 50 and into the interior of the cavity 50. The sprayed foam rises along the web faces as well as in the stud cavity 50 so as to fill the same.

A sufficient amount of foam is sprayed along the web faces so that upon its normal expansion the foam overlaps the nailing faces 24. This overlap 52 interconnects the cured foam 61 between the adjacent stud cavities 50 which diminishes the effects of any separation of the foam 61 away from the web faces 26, 28 of the studs 20 as a thermal barrier 52 transversing these faces is presented. Accordingly, any lateral air infiltration through gaps arising along the web faces 26, 28 is blocked by this foldover 52. Also as the first row 12 of studs 20 is isolated from the second row 14 of studs 30 no continuous thermal path between the interior and exterior walls via the interposed studs 20, 30 is presented.

Subsequent to spraying, fiberglass batts 60 (R-value=19) are conventionally placed between the opposing faces 36, 38 of the adjacent interior studs 30. It is here noted that such batts 60 being less expensive than the above-described foam 61, are utilized to address the cost of the entire wall assembly 10. A continuous plastic sheet 66 is then applied to the faces 34 of studs 30 so as to present a vapor barrier precluding the passage of damaging moisture therethrough. The paper backing 62 of the batt insulation 60 has been scored 64 to preclude any vapor buildup therebetween. Wall board 70 or the like is then affixed to the nailing face 34 of the studs 30 and conventionally finished to present a second insulated wall section in a side-by-side relationship with the first wall section as above-described.

As shown, it is preferred that the insulation batts 60 of the second wall section contact the polyurethane foam 61 of the first wall section to preclude any gaps therebetween. Also it is preferred that the foam 61 contacts the nailing face 32 of the stud 30 which extends into each cavity 50 so as to preclude any spatial displacement therebetween. Otherwise the temperature differences between the outside and inside walls can promote the appearance of rising hot air and falling cold air in these gaps so as to create convection currents flowing therein. Such air infiltration and/or currents can degrade the overall R-value of the wall assembly 10.

Thus, as best illustrated in FIG. 3, a first wall section including a continuous, serpentine sheet of cured polyurethane foam extending among the stud cavities 50 and between the rows 12, 14 of studs 30, 20 is presented. This first wall section cooperates with the above-described second wall section to present an air impervious wall assembly 10 (R-value=30) which effectively inhibits any air infiltration and cost-effectively resists thermal flow between the interior 70 and exterior sheathings 42, 43.

Figure 5:
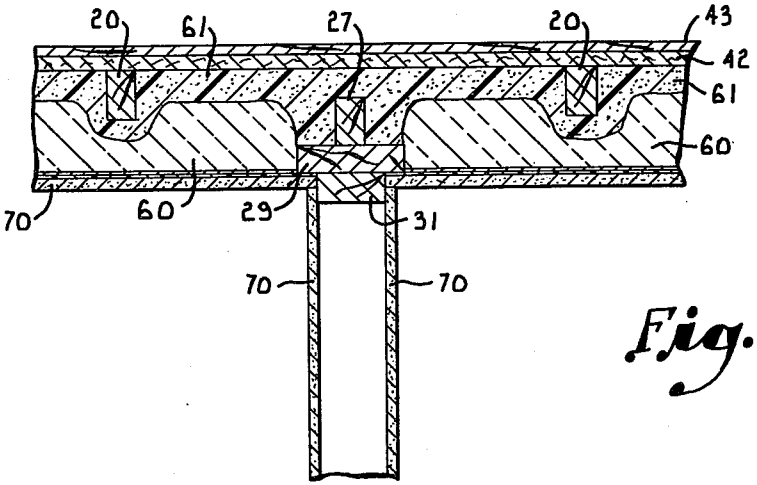
FIG. 5 is a sectional plan view illustrating the tie-in of an interior room wall with a wall assembly.
Figure 4:
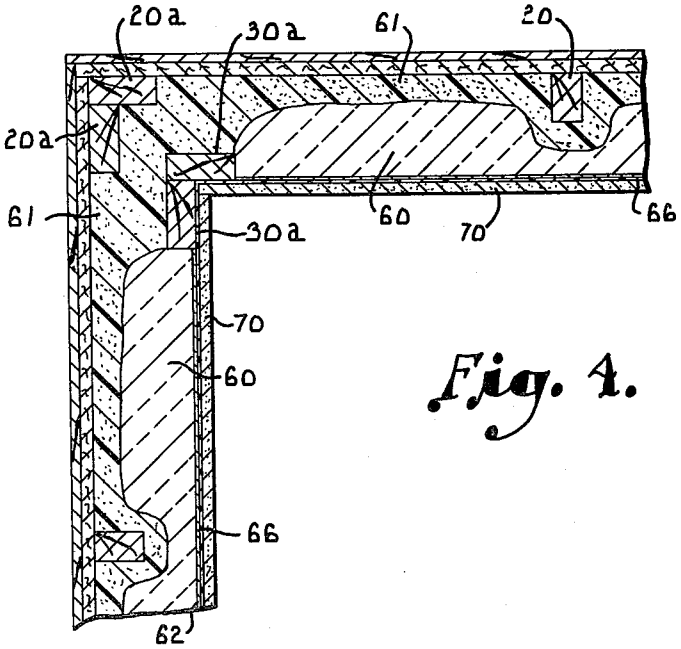
FIG. 4 is a sectional plan view illustrating a corner construction for intersecting wall assemblies.

FIGS. 4 and 5 illustrate the utilization of my wall assembly 10 in corner wall construction (FIG. 4) and interior wall-tie construction (FIG. 5). As illustrated in FIG. 4, the corner studs 20a and 30a are normally butted together to present inside and outside bracing for nailing the sheathing and wall board thereto. The wall-tie construction is illustrated in FIG. 5. An interior 2×6 stud 29 replaces the normal stud 30 and is positioned as shown to allow a 2×4 interior wall stud 31 to be nailed thereto. On the opposed side of the interior stud 30 a 2×3 bracing stud 27 is provided. The foam 61 is then sprayed along the corner bracing (FIG. 4) and wall-tie bracing (FIG. 5) so as to fill the surrounding space as respectively shown in FIGS. 4 and 5. Subsequent to spraying the insulation batts 60 are placed between the adjacent studs in a manner as above described.

It is to be understood that while certain forms of this invention have been illustrated and described, it is not limited thereto, except in so far as such limitations are included in the following claims.

Having thus described the invention, what is claimed as new and desired to be secured by Letters Patent is:

1. An exterior wall assembly comprising:

a first row of longitudinally spaced apart studs each stud presenting an inner and outer nailing face with a pair of web faces extending therebetween;

a second row of longitudinally spaced apart studs each stud presenting an inner and outer nailing face with a pair of web faces extending therebetween, said second row of studs being longitudinally and laterally offset from said first row of studs, said lateral offset of each stud of said second row of studs extending a selected nailing face of at least one stud of said second row of studs into the area between adjacent studs of said first row of studs;

means for maintaining said first and second row of studs in a generally vertical relationship;

first sheathing means affixed to said outer nailing faces of said first row of studs, said first sheathing means having an inner surface cooperating with the opposing web faces of adjacent studs of said first row of studs to form a series of first side-by-side stud cavities having at least a nailing face of said at least one stud of said second row of studs protruding therein;

a first insulating material spray-applied on the exposed faces of each stud of said first row of studs and along said inner surface of said sheathing means to present, upon curing, a generally rigid serpentine sheet of said first insulating material in said first stud cavities, said insulating sheet continuously extending between said first cavities whereby to position each stud of said first row of studs between said insulating sheet and said sheathing means, said sheet further contacting said protruding face of said at least one stud of said second row of studs and cooperating with the opposing web faces of adjacent studs of said second row of studs to present a series of second side-by-side stud cavities adjacent said first insulated stud cavities; and a relatively flexible second insulating material positioned in said second stud cavities, said second insulating material extending between said adjacent studs of said second row of studs and contiguous to said sheet to present a series of contiguously adjacent and longitudinally offset first and second insulated stud cavities precluding air infiltration through said cavities and the appearance of air spaces therebetween whereby to present an exterior wall assembly highly resistive to thermal flow therethrough.

2. The apparatus as claimed in claim 1 further comprising second sheathing means affixed to said nailing faces of said second row of studs to present an interior wall.

3. The apparatus as claimed in claim 2 further comprising a vapor barrier interposed between said second row of studs and said second sheathing means to inhibit passage of moisture therethrough.

4. A method of constructing an exterior wall comprising the steps of:

a. positioning a first row of vertically disposed studs having inner and outer nailing faces and a web face therebetween in a longitudinally aligned and spaced-apart relationship therebetween;

b. positioning a second row of vertically disposed studs having inner and outer faces and a web face therebetween in a longitudinally aligned and spaced-apart relationship therebetween;

c. laterally and longitudinally offsetting said second row of studs from said first row of studs in a manner whereby at least one stud of each row of studs protrudes into the area between adjacent studs of the other row of studs;

d. affixing wall sheathing to said outer nailing faces of each stud of said first row of studs with an inner surface of said sheathing presenting a series of first stud cavities between adjacent studs of each first row of studs;

e. spraying a foam insulation on said inner surface of said sheathing to insulate upon curing said first stud cavities between the studs thereof;

f. overspraying said foam insulation on the exposed faces of each stud of said first row of studs whereby to isolate each stud of said first row of studs between said insulation and said sheathing means;

g. spraying said foam insulation in each stud cavity to a level whereby upon curing said insulation contacts at least one face of each stud of said second row of studs protruding into said first stud cavities whereupon said sprayed insulation upon curing spans said adjacent studs of said second row of studs;

h. curing said foam insulation to present a rigid serpentine sheet of first material insulating said first stud cavities, isolating said first row of studs and spanning said studs of said second row of studs;

i. insulating the series of second stud cavities presented by said rigid serpentine sheet of first insulating material extending between the adjacent studs of said second row of studs, whereby to present a thermally insulated wall assembly comprising a series of contiguously adjacent and longitudinally offset first and second stud cavities generally impervious to air infiltration and thermal flow therethrough.

5. The method as claimed in claim 4 further comprising the step of applying a vapor barrier between said wall sheathing and said adjacent insulation to preclude the passage of moisture therethrough.

* * * * *